US005594973A

United States Patent [19]

Brusseleers et al.

[11] Patent Number: 5,594,973

[45] Date of Patent: Jan. 21, 1997

[54] DEVICE FOR CLEANING THE WALL OF A SILO

[75] Inventors: Joseph Brusseleers, St.-Job-In't-Goor; Jan Claes, Duffel, both of Belgium

[73] Assignee: Solvay (Société Anonyme), Brussels, Belgium

[21] Appl. No.: 481,485

[22] PCT Filed: Jan. 7, 1994

[86] PCT No.: PCT/EP94/00062

§ 371 Date: Aug. 22, 1995

§ 102(e) Date: Aug. 22, 1995

[87] PCT Pub. No.: WO94/15728

PCT Pub. Date: Jul. 21, 1994

[30] Foreign Application Priority Data

Jan. 12, 1993 [BE] Belgium ..... 09300025

[51] Int. Cl.[6] ..... B08B 9/08; B08B 5/02

[52] U.S. Cl. ..... 15/304; 15/312.1; 15/316.1; 134/167 R; 239/227; 239/264; 239/751

[58] Field of Search ..... 15/304, 316.1, 15/56, 312.1; 134/167 R; 239/227, 264, 751

[56] References Cited

U.S. PATENT DOCUMENTS

| | | | |
|---|---|---|---|
| 1,616,777 | 2/1927 | Booth | 15/56 |
| 2,302,078 | 11/1942 | Wadman | 15/304 X |
| 2,692,725 | 10/1954 | Hensgen | 15/304 X |
| 3,715,774 | 2/1973 | Fannon | 15/312.1 X |
| 3,994,310 | 11/1976 | Brandon | 134/167 C |
| 4,201,597 | 5/1980 | Armstrong et al. . | |
| 4,380,842 | 4/1983 | Thomas | 15/304 |
| 4,805,650 | 2/1989 | Yasui et al. . | |
| 5,107,879 | 4/1992 | Harvey | 239/227 X |

FOREIGN PATENT DOCUMENTS

| | | |
|---|---|---|
| 454746 | 6/1968 | Switzerland . |
| 686842 | 2/1953 | United Kingdom . |
| 2146264 | 4/1985 | United Kingdom . |

OTHER PUBLICATIONS

Gyrowhip; Northern Vibrator Manufacturing Ltd. Brochure, Gyro–Whip Bin Cleaning Systems, Northern Vibrator Mfg. Ltd., Georgetown, Ontario, Canada.

Airnesco Brochure, Technical Information and Operating Instructions, The Airnesco Bunker lances N2, N3 and N4, Airnesco International Limited, Rochester, Kent, England.

*Primary Examiner*—Chris K. Moore

*Attorney, Agent, or Firm*—Spencer & Frank

[57] ABSTRACT

Device for cleaning the wall (1, 23) of a silo, comprising a compressed-air gun (12) suspended from two cables (14, 15) which are connected to two separate winches (16, 17), bearing on two pulleys (9, 10) fastened to a frame (6) which is arranged inside the silo and which is fixed to a rotary plate (4) which can move on a circular track (5) above an opening (2) in the silo.

9 Claims, 1 Drawing Sheet

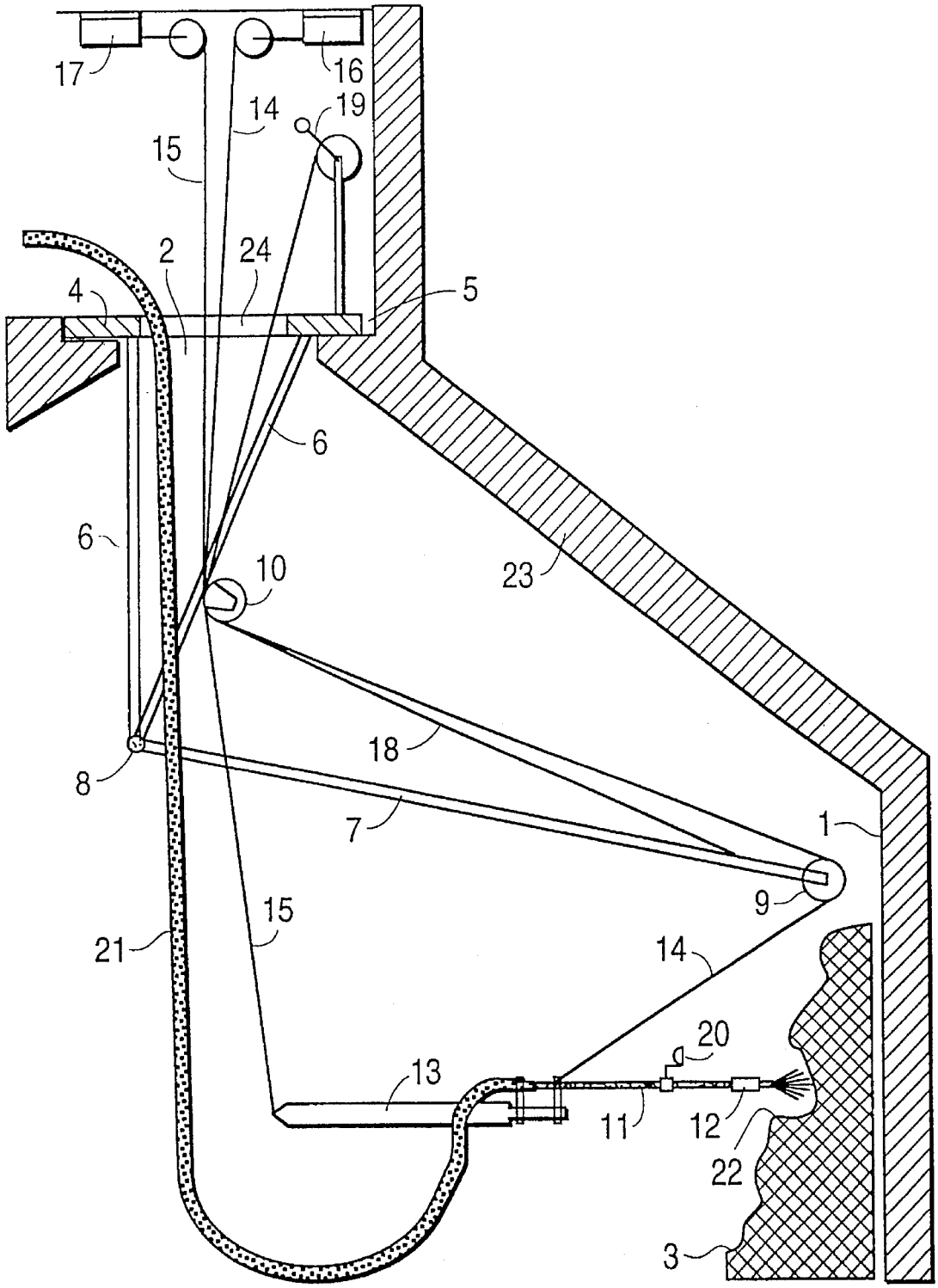
17
16
14
19
15
2
24
4
5
6
6
10
23
18
8
7
1
9
15
21
14
20
13
11
12
22
3

DEVICE FOR CLEANING THE WALL OF A SILO

FIELD OF THE INVENTION

The invention relates to the cleaning of silos used for storing industrial products such as, for example, sodium carbonate.

It relates more particular to a device for cleaning such a silo.

TECHNOLOGY REVIEW

Silos intended for storing industrial products must be cleaned periodically. Thus some industrial products, especially powdered sodium carbonate, have the tendency, under the effect of gravitational forces, to stick together and to form encrustations on the wall of the silo. Depending on the case, these encrustations generally tend to increase in size over the course of time, so that they reduce, sometimes considerably, the working capacity of the silos and run the risk, in the long-term, of blocking up the draw-off chutes.

A first method used for detaching encrustations from the wall of a silo consists in striking them by means of a manually operated percussion tool. This method implies the presence of an operator inside the silo, something which is dangerous and is generally proscribed by safety regulations in the case of large silos.

It has also been proposed to detach the encrustations, by means of a milling cutter which is moved along the wall. A known device, designed for this purpose, comprises a metal frame which can move inside the silo, carrying the milling cutter, the frame being able to rotate through 360 degrees on a circular running track arranged above an opening in the silo [NORTHERN VIBRATOR MANUFACTURING LTD Brochure, Gyro-Whip Bin Cleaning Systems, Northern Vibrator Mfg. Ltd., Georgetown, Ontario, Canada; Patent GB-2,146,264 (NORTHERN VIBRATOR Mfg. Ltd.)]. This known device has the advantage of being able to be operated from outside the silo. However, it is difficult to handle, its productivity is low and the milling cutter risks, moreover, damaging the wall of the silo.

In order to avoid the problems associated with the use of a milling cutter, it has been envisaged to detach the encrustations by means of a compressed-air gun mounted at the end of a jib which can be operated manually inside the silo from a manhole made in the wall of the silo (AIRNESCO Brochure, Technical Information and Operating Instructions, The Airnesco Bunker lances N2, N3 and N4, Airnesco International Limited, Rochester, Kent, England). This known means has the drawback of being difficult, imprecise and tiring to handle.

SUMMARY OF THE INVENTION

The invention remedies the aforementioned drawbacks by providing a novel device for cleaning silos, the handling of which is easy and precise, which is effective and has an optimum productivity and with which the risk of damaging the wall of the silo is a minimum.

The invention therefore relates to a device for cleaning the wall of a silo, comprising a compressed-air gun which can move inside the silo, the gun being suspended for this purpose from two cables which are fixed respectively on either side of its centre of gravity and which are connected respectively to two winches, bearing respectively on two pulleys fastened to a frame which is arranged inside the silo and which is fixed to a rotary plate which can move on a circular track above an opening in the silo.

BRIEF DESCRIPTION OF THE DRAWING

The FIGURE shows partially, in vertical axial section, the upper region of a silo whose side wall (1) is pierced in its upper part by a manhole (2). An agglomeration (3) of a solid substance adheres to the wall (1). In order to detach the agglomeration (3) from the wall, a device in accordance with the invention is inserted into the silo via the manhole (2). The illustrated device is described below.

DETAILED DESCRIPTION OF THE INVENTION

In the device according to the invention, the compressed-air gun is an apparatus well known from a technical standpoint, which is designed to blast, in a defined direction, a blast of compressed air. The flow rate of the blast of compressed air, its temperature and its pressure may all be regulated as required, using a compressor, valves and a pressure regulator, depending on the magnitude of the encrustations to be detached and on the nature of these encrustations. In practice, it is possible, for example, to regulate the pressure of the compressed air between 0.4 and 1.5 MPa. Examples of compressed-air guns which can be used in the device according to the invention are described in the aforementioned AIRNESCO brochure and in Document GB-A-686842 (AIRNESCO).

The compressed-air gun is suspended in the silo by two cables connected respectively to two separate winches. The two cables are fixed to the gun, respectively on either side of the centre of gravity of the gun. The winches move the gun vertically inside the silo. Since the winches can be operated separately, they allow moreover the gun to be pivoted through 180 degrees in the vertical plane.

The frame and the rotary plate have the function of orienting the gun in the horizontal plane. For this purpose, the cables supporting the gun bear separately on two separate pulleys on the frame so that the movement of the plate on the circular and generally horizontal track rotates the frame and the gun through 360 degrees about a vertical axis.

By combining the operation of the winches with the operation of the rotary plate, it is possible to position the gun in an optimum fashion with respect to an encrustation to be detached from the wall. Furthermore, by an appropriate operation of the winches, it is possible to orient, as required, the angle of the blast of compressed air blasted onto the encrustation to be treated.

In the device according to the invention, the winches and at least one of the pulleys are preferably arranged in the immediate vicinity of the vertical passing through the centre of the aforementioned circular track.

In one particular embodiment of the device according to the invention, one of the pulleys is mounted at one end of a jib which is pivoted to the frame at its other end. In this embodiment of the invention, the pivoting of the jib to the frame is designed so as to allow rotation of the jib about a horizontal axis in order to move the gun further away from or closer to the wall of the silo.

In the device according to the invention and its particular embodiment which has just been described, the winches may advantageously be arranged outside the silo and the cables then pass through a central opening in the rotary plate which, for this purpose, is annular.

In another embodiment of the device according to the invention, the compressed-air gun includes a stabilizing weight. The function of this is to absorb, by inertia, the reaction force of the blast of compressed air on the gun so as to reduce the amplitude of oscillations of the gun and to stabilize it in the silo.

In a further embodiment of the device according to the invention, the compressed-air gun carries a television camera connected to a receiver located outside the silo. In this embodiment of the device according to the invention, the television camera is oriented towards the front of the gun and its function is to display the front of the encrustation subjected to the blast of compressed air. The television camera therefore allows permanent visual monitoring of the wall of the silo, thereby making it much easier to operate the winches and the frame in order to alter the position and orientation of the gun.

The device according to the invention is applicable to the cleaning of any silo containing an industrial product, for example grain, coal or ore silos. It finds one particular application in disencrusting silos which are used for storing powdered sodium carbonate.

DESCRIPTION OF A PREFERRED EMBODIMENT

Particular features and details of the invention will emerge from the following description of the single FIGURE of the appended drawing, which shows a preferred embodiment of the device according to the invention during use in a silo.

The FIGURE shows partially, in vertical axial section, the upper region of a silo whose side wall 1 is pierced in its upper part by a manhole 2. An agglomeration 3 of a solid substance (for example sodium carbonate) is adhering to the wall 1. In order to detach the agglomeration 3 from the wall, a device in accordance with the invention is inserted into the silo via the manhole 2. This device comprises a rotary annular plate 4 based on a horizontal circular track 5 made on the periphery of the manhole 2. The circular track 5 and the plate 4 are designed to allow the plate to rotate through 60 degrees on the circular track 5. The plate 4 carries a frame 6 of metal beams inside the silo. A jib 7 is pivoted to the frame 6 on a ball joint 8 so that it can pivot in a vertical plane about a horizontal axis. A pulley 9 is fixed to the free end of the jib 7 and three coaxial and independent pulleys 10 are fixed to the frame 6 beneath the central opening 24 in the annular plate 4. The pulleys 10 are positioned substantially on the vertical axis passing through the centre of the circular track 5. The inclination of the jib 7 is controlled by means of a cable 18 which is connected, via one of the three pulleys 10, to a winch 19 located outside the silo, above the manhole 2.

An arm 11, carrying a compressed-air gun 12 and a balance weight 13, is suspended in the silo from two cables 14 and 15 which pass through the central opening 24 in the annular plate 4 and are connected respectively to two separate winches 16 and 17 located outside the silo, above the manhole 2, in the immediate vicinity of the vertical axis of the circular track 5. The cables 14 and 15 are fixed respectively on either side of the centre of gravity of the assembly formed by the arm 11, the gun 12 and the balance weight 13. They bear respectively on two of the three pulleys 10, the cable 14 moreover bearing on the pulley 9. The gun 12 carries a television camera 20 oriented towards the front of the gun. A hose 21 passing through the opening 24 in the plate 4 is fixed to the arm 11. This hose contains a conduit for supplying the gun 12 with compressed air produced by a compressor, not shown, located outside the silo. The hose 21 furthermore contains a cable for connecting the camera 20 to a television receiver, not shown, located outside the silo.

In order to detach the agglomeration 3 from the wall 1 of the silo, the gun 12 is firstly brought opposite a region 22 of the agglomeration to be attacked. For this purpose, the plate 4 is suitably oriented on the track 5 in order to bring the gun into the vertical axial plane of the region 22 and the winches 16, 17 and 19 are operated in order to bring the gun 12 level with the region 22. Moreover, by combining the actuation of the winches 16, 17 and 19, the height of the gun in the silo, its distance from the wall and its inclination are altered as required, it is especially possible, by means of the winches 16 and 17, to orient the arm 11 so that it occupies a horizontal position (as shown in the FIGURE), a position in which the gun 12 is directed obliquely downwards, or a position in which the gun is directed obliquely upwards. It is advantageous to be able to orient the gun 12 obliquely in order to attack an oblique face of the agglomeration 3 or to clean an inclined face 23 of the wall. The camera 20 allows the optimum position of the gun 12 to be found easily and precisely.

When the gun 12 has reached the correct position facing the agglomeration 3, it is brought into communication with the compressor so as to blast the region 22 of the agglomeration 3 with a blast of compressed air. The camera 20 allows the action of the blast of compressed air on the agglomeration to be monitored. As the pieces of agglomeration 3 are detached under the effect of the blast of compressed air (which is sent by successive pulses), the position and orientation of the gun 12 are altered by means of the plate 4 and the winches 16, 17 and 19.

In order to insert the device into the silo or to extract it therefrom, it is enough to operate the winches 16, 17 and 19 so as to bring the jib 7 and the arm 11 into a substantially vertical position in order to allow them to pass through the manhole 2.

What is claimed is:

1. A device for cleaning the wall (1, 23) of a silo, comprising a compressed-air gun (12) which can move inside the silo, characterized in that the gun (12) is suspended from two cables (14, 15) which are fixed respectively on either side of its centre of gravity and which are connected respectively to two separate winches (16, 17), bearing respectively on two pulleys (9, 10) fastened to a frame (6) which is arranged inside the silo and which is fixed to a rotary plate (4) which can move on a circular track (5) above an opening (2) in the silo.

2. The device according to claim 1, wherein one of the aforementioned pulleys (9) is mounted at one end of a jib (7) which is pivoted, at its other end (8), to the frame (6).

3. The device according to claim 2, wherein the jib (7) is suspended from a cable (18) connected to a winch (19).

4. The device according to claim 2, wherein the winches (16, 17, 19) are located outside the silo, the cables (14, 15, 18) passing through a central opening (24) in the rotary plate (4).

5. The device according to claim 4, wherein the cables (14, 15, 18) bear on pulleys (10) fastened to the frame (6), beneath the central opening (24) in the rotary plate (4).

6. The device according to claim 1, wherein the gun (12) comprises a stabilizing weight (13).

7. The device according to claim 1, wherein the winches (16, 17, 19) can be operated individually.

8. The device according claim 1, wherein the gun (12) carries a television camera (20) connected to a receiver located outside the silo.

9. The device according to claim 1, wherein the silo is intended to contain powdered sodium carbonate.

* * * * *